United States Patent [19]

Roossien et al.

[11] Patent Number: 4,494,795

[45] Date of Patent: Jan. 22, 1985

[54] VARIABLE BACK ADJUSTER FOR CHAIRS

[75] Inventors: Charles P. Roossien, Wyoming; Brian Chambers, Byron Center; Bruce Hiemstra, Jenison, all of Mich.

[73] Assignee: Steelcase Inc., Grand Rapids, Mich.

[21] Appl. No.: 375,550

[22] Filed: May 6, 1982

[51] Int. Cl.[3] ..... A47C 1/024

[52] U.S. Cl. ..... 297/355; 108/9; 297/361

[58] Field of Search ..... 297/361, 362, 366–369, 297/354, 355; 248/561; 108/9

[56] References Cited

U.S. PATENT DOCUMENTS

| | | | |
|---|---|---|---|
| 964,394 | 7/1910 | Coddington . | |
| 1,302,212 | 4/1919 | Phillips . | |
| 2,579,305 | 12/1951 | Cushman . | |
| 3,046,055 | 7/1962 | Martens | 297/361 |
| 3,062,584 | 11/1962 | Galla | 297/374 |
| 3,127,788 | 4/1964 | Martens | 74/586 |
| 3,246,868 | 4/1966 | Martens et al. | 248/355 |
| 3,339,975 | 9/1967 | Posh | 297/361 |
| 3,350,135 | 10/1967 | Martens | 297/361 |
| 3,356,411 | 12/1967 | Homier et al. | 297/355 |
| 3,369,841 | 2/1968 | Heyl, Jr. | 297/361 |
| 3,398,986 | 8/1968 | Homier | 297/355 |
| 3,603,640 | 9/1971 | Doerner | 297/292 |
| 3,799,485 | 3/1974 | Wolters | 248/406 |
| 3,799,486 | 3/1974 | Mohr | 248/406 |
| 3,991,965 | 11/1976 | Westover | 248/406 |
| 4,234,152 | 11/1980 | Browse | 248/415 |
| 4,390,206 | 6/1983 | Faiks et al. | 248/561 X |

FOREIGN PATENT DOCUMENTS 3039656 5/1982 Fed. Rep. of Germany .

*Primary Examiner*—William E. Lyddane
*Assistant Examiner*—Peter R. Brown
*Attorney, Agent, or Firm*—Price, Heneveld, Huizenga & Cooper

[57] ABSTRACT

An adjustor for chairs with tilting backs and the like, comprises a threaded spindle connected with the chair back, and a gear wheel threadedly mounted on the spindle. The gear wheel is retained in a housing attached to a relatively stationary portion of the chair, such that when the chair back is tilted, the spindle rotates the gear wheel in the housing. A pawl is shifted into and out of engagement with the gear wheel to selectively lock the chair back in a wide variety of different angular positions.

31 Claims, 14 Drawing Figures

VARIABLE BACK ADJUSTER FOR CHAIRS

BACKGROUND OF THE INVENTION

The present invention relates to tilt back chairs, and the like, and in particular to a variable back adjustor therefor.

Chairs with tilting backs are well known in the art, particularly in office furniture seating. A chair with an articulated back and seat control is disclosed in copending U.S. patent application Ser. No. 145,854, filed May 1, 1980, entitled SYNCHROTILT CHAIR CONTROL, which is commonly assigned to the present assignee, and is hereby incorporated by reference.

In the above-referenced chair control, the chair back can be locked only in either the fully upright position or the fully reclined position. It is quite advantageous to be able to lock the chair in a wide variety of different angular positions to accommodate various personnel and working environments.

Another problem encountered in the aforementioned chair control is that the articulated back and seat mechanism requires a very strong return spring to insure that the chair normally assumes a fully upright position. Hence, the force acting on the locking mechanism is rather high, thereby requiring a commensurately high force to shift the locking mechanism between the locked and unlocked positions. Although toggle button controllers have a very neat, sleek appearance, heretofore they have not been adapted to transmit substantial shifting forces to the locking mechanism, as are the long lever arrangements which are normally used to lock and unlock the chair back.

Pneumatic and hydraulic seat back adjusters are prone to wear, and are therefore generally not considered to be very reliable.

SUMMARY OF THE INVENTION

One aspect of the present invention is a variable back adjustment mechanism for chairs of the type having a tilting back which pivots with respect to a relatively stationary, mounting portion of the chair. The adjustor comprises a threaded spindle having one end connected with either the chair back or the mounting portion of the chair. A gear wheel is threadedly mounted on the spindle, and is retained in a housing which is attached to the other of the chair back and mounting portions of the chair, such that tilting the chair back translates the spindle axially through the gear wheel, and thereby rotates the gear wheel in the housing. A pawl is movably connected with the chair, and is positioned to selectively engage the gear wheel to positively prevent rotation of the gear wheel with respect to the spindle. Means are provided for shifting the pawl into and out of engagement with the gear wheel between locked and unlocked positions respectively, whereby the chair back can be locked in a plurality of different angular positions.

Preferably, the pawl shifting means includes a toggle button located on a conveniently accessible portion of the chair, which is connected by a link with the pawl to manipulate the same. An over-centered spring arrangement is connected with the pawl to resiliently urge the pawl either into the fully locked position or the fully unlocked position.

The principal objects of the present invention are to provide a mechanism capable of adjusting the chair back into a wide variety of different angular positions.

The adjustor positively locks the chair back in the selected attitude, yet has a relatively low release force to facilitate easy unlocking of the chair back when further adjustment is desired. The adjustor is particularly adapted for use in conjunction with an on-off, or toggle button type of release, which provides a very convenient, purely mechanical mechanism by which the chair back can be locked and released. The adjustor is reliable, efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
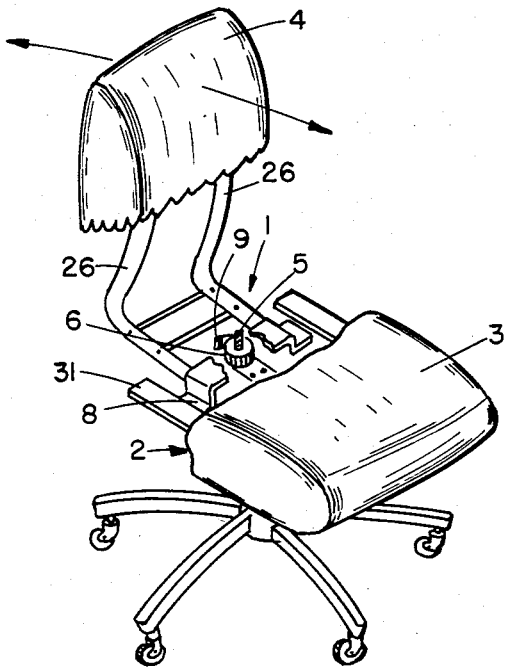
FIG. 1 is a partially schematic, perspective view of a tilt back chair, with portions thereof broken away to reveal a variable back adjustor embodying the present invention.
Figure 2:
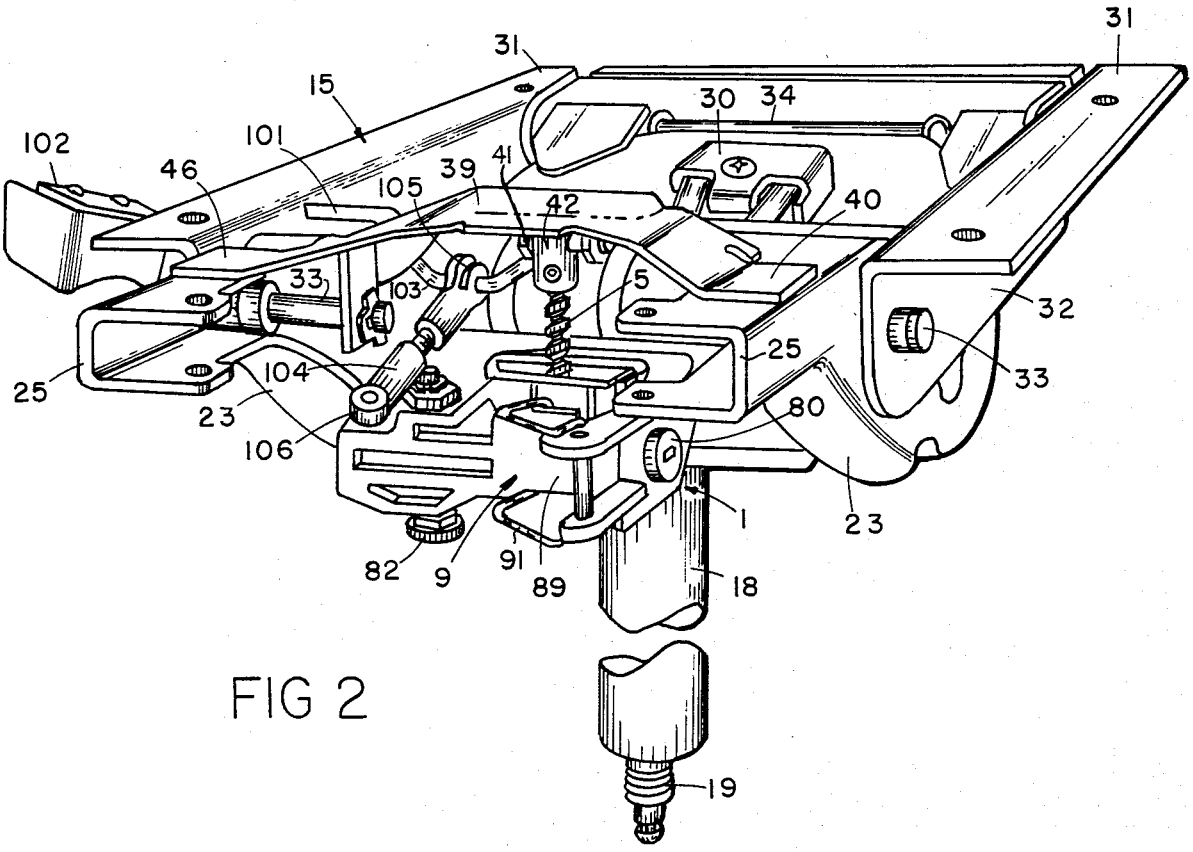
FIG. 2 is a rear perspective view of the adjustor.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary.

The reference numeral 1 (FIG. 1) generally designates a variable back adjustor embodying the present invention, shown installed in a chair 2, having an articulated seat 3 and back 4. Adjustor 1 comprises a threaded spindle 5 connected with chair back 4, with a gear wheel 6 threadedly mounted on spindle 5. Gear wheel 6 is retained in a housing 7, which is attached to a relatively stationary portion of chair 2, such as control housing 8, whereby when chair back 4 is tilted, spindle 5 rotates gear wheel 6 in housing 7. A pawl 9 is shifted into and out of engagement with gear wheel 6 to selectively lock chair back 4 in a wide variety of different angular positions.

In the illustrated example, adjustor 1 is shown installed in a chair control 15 of the type disclosed in the above-referenced co-pending U.S. patent application Ser. No. 145,854, filed May 1, 1980, entitled SYNCHROTILT CHAIR CONTROL, which has been incorporated by reference herein. However, it is to be understood that adjustor 1 can be used in conjunction with a wide variety of different types of articulated and tilt back chairs, as will be readily appreciated by those skilled in the art.

Figure 5:
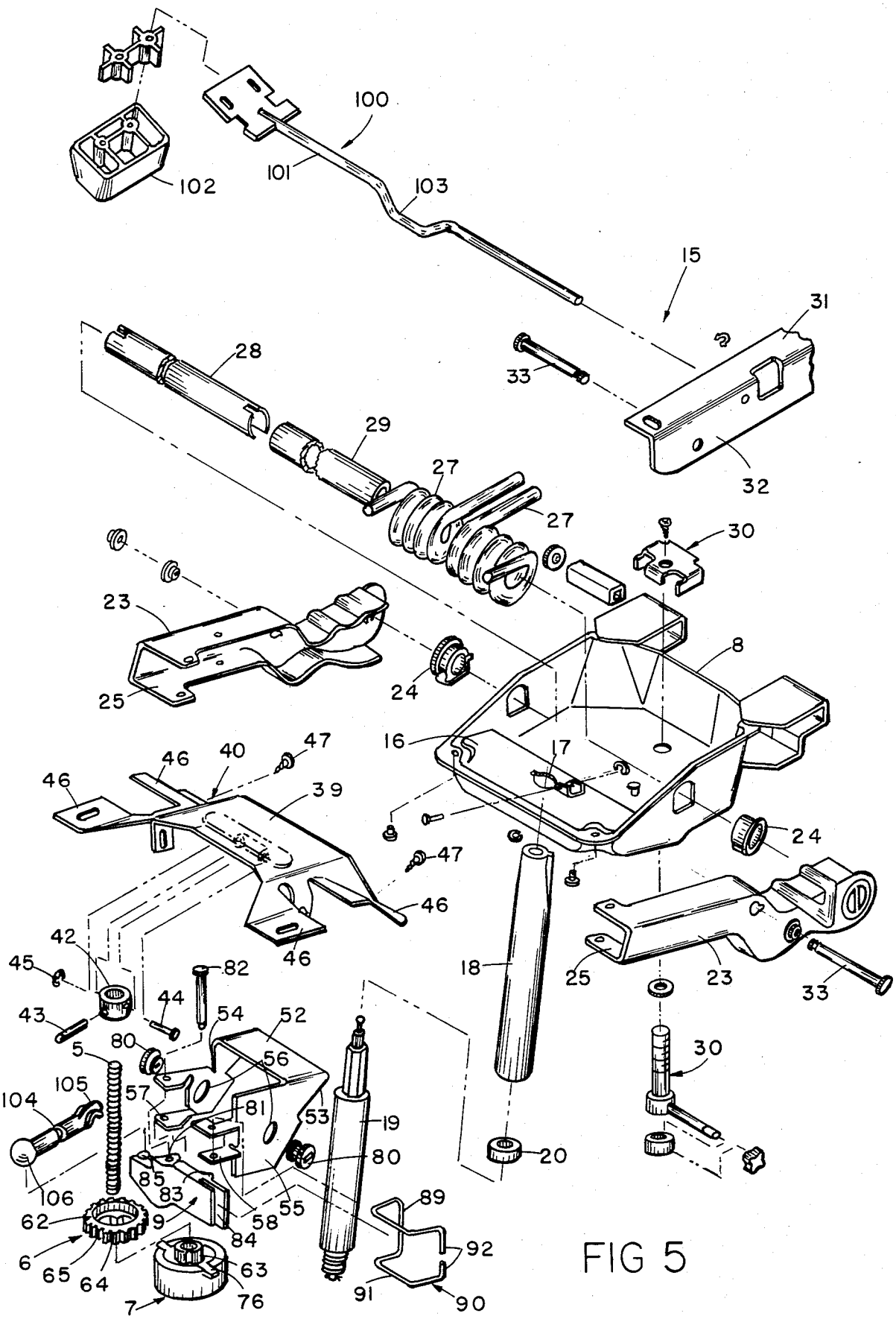
FIG. 5 is an exploded, perspective view of the adjustor and associated chair control parts to which the adjustor is attached.
Figure 6:
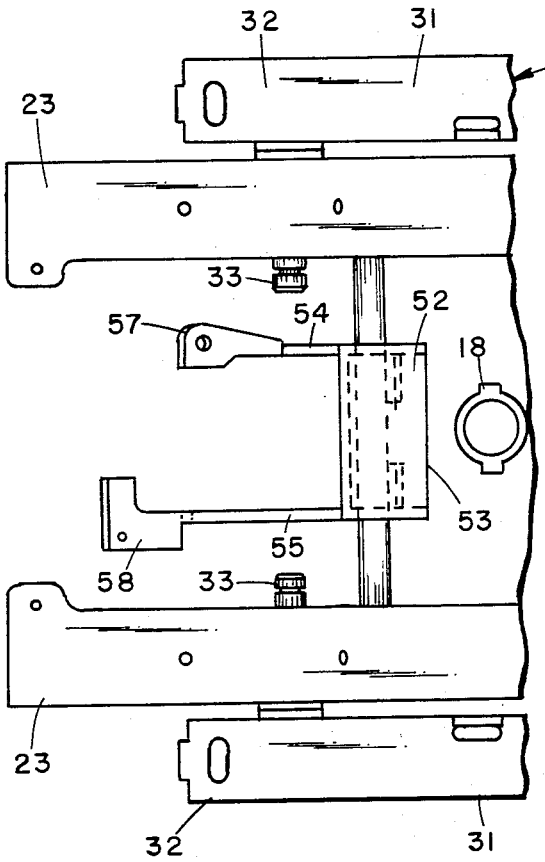
FIG. 6 is a fragmentary, top plan view of the chair control, particularly showing a bracket for the adjustor.

With reference to FIG. 5, the illustrated chair control 15 comprises stationary control housing 8 in the form of a stamped metal dish. Stationary housing 8 includes a reinforcing bracket 16 extending along the forward edge thereof with an aperture 17, which in conjunction with an aligned aperture in the base of housing 8, define a socket 14 in which the upper end of a support column 18 is received. Column 18 is supported on a pneumatic cylinder 19 to adjust the vertical height of the chair. In this example, an adapter 20 is provided to facilitate attaching pneumatic cylinder 19 with support column 18.

Figure 3:
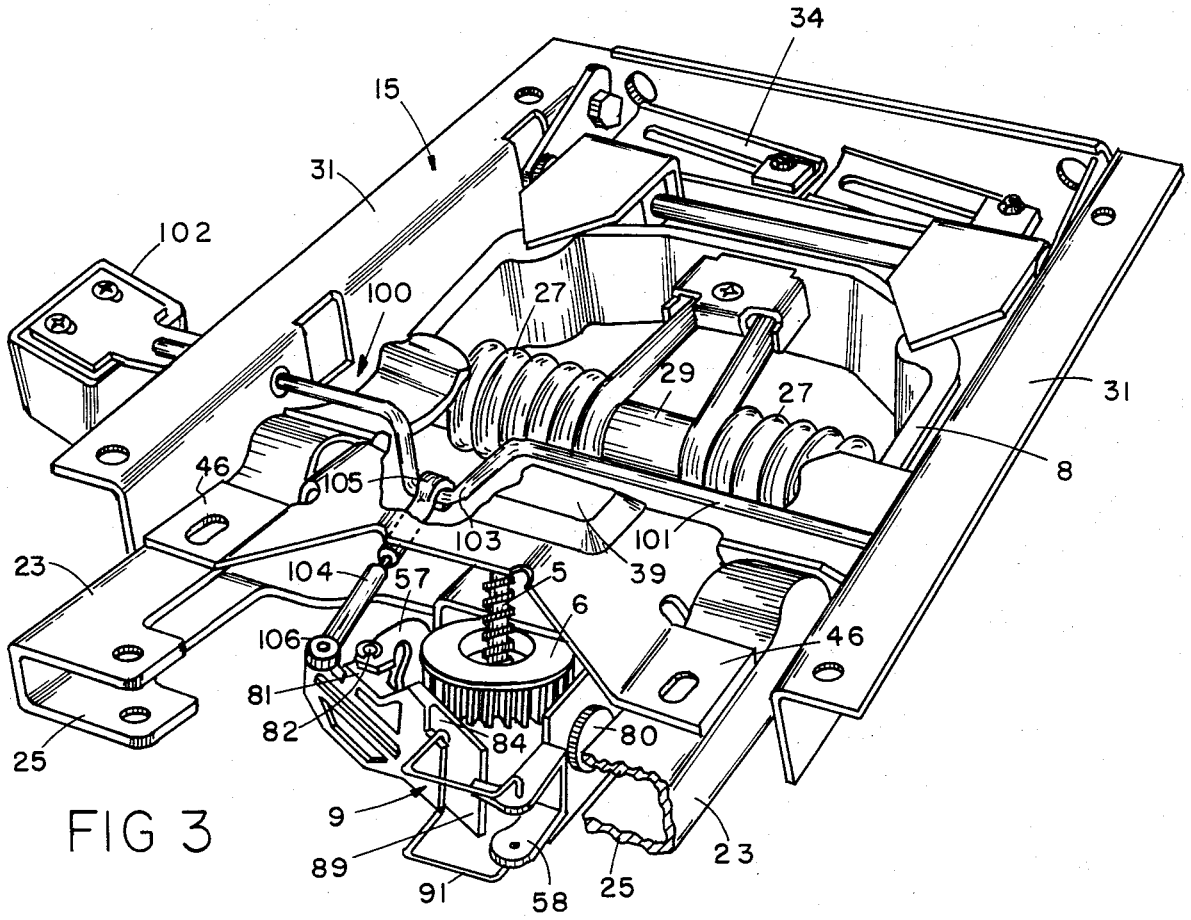
FIG. 3 is another rear perspective view of the adjustor.

A pair of left and right-hand, rear stretches 23 support seat back 4, and are pivotally attached to the sides of stationary housing 8 by bearings 24. The rearward ends of the stretchers 23 form inwardly opening, U-shaped brackets 25 into which the ends of a tubular chair back support member 26 (FIG. 1) are received and retained. A coil-type return spring 27 is mounted in stationary housing 8 by a pair of concentric sleeves 28 and 29. A tension controller 30 is provided to adjust the tension of return spring 27. A pair of left and right-hand front stretchers 31 support the seat portion 3 of chair 2, and have their rearward ends 32 pivotally connected with rear stretchers 23 by pins 33. As best illustrated in FIG. 3, the forward ends of front stretchers 31 are attached to stationary housing 7 by an adjustment mechanism 34.

Figure 8:
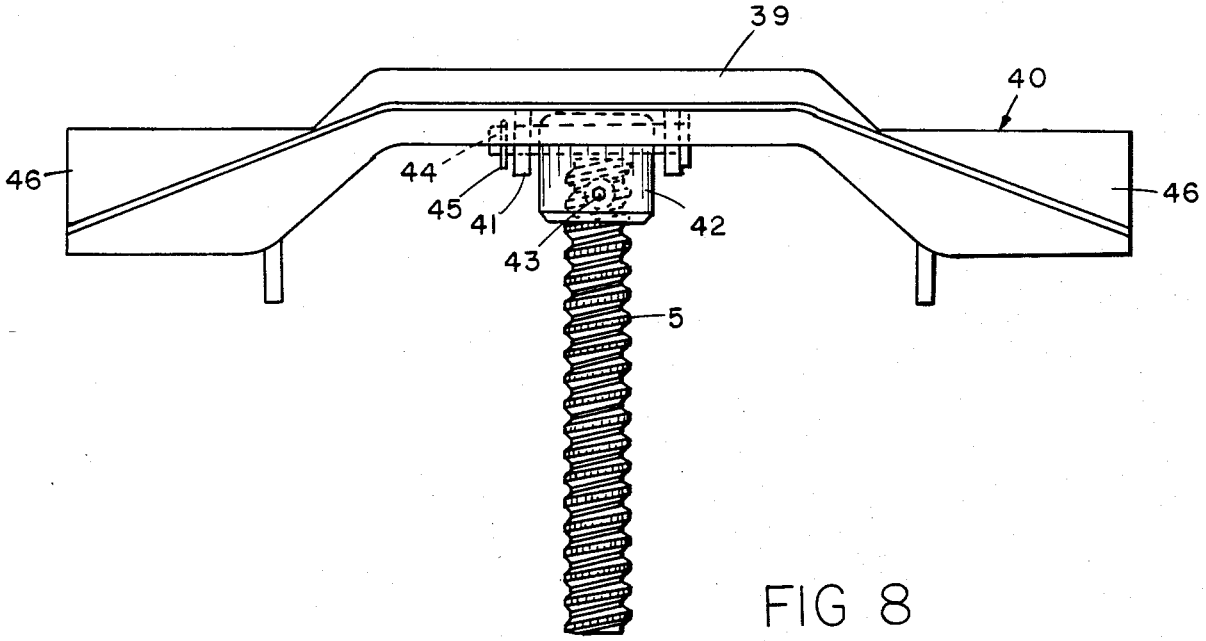
FIG. 8 is a front elevational view of a threaded spindle portion of the adjustor, shown attached to a mating bracket.
Figure 9:
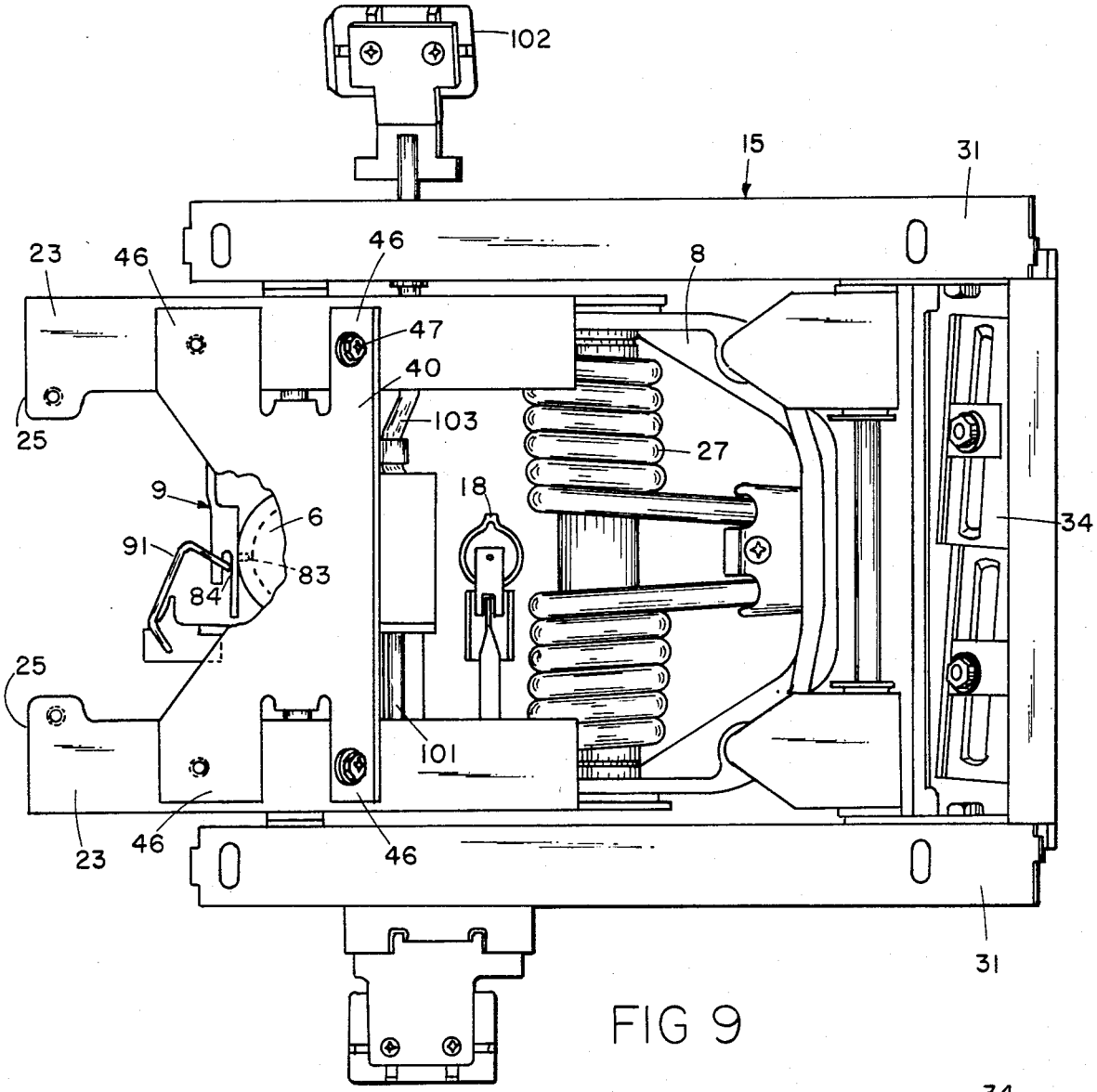
FIG. 9 is a top plan view of the chair control, with a portion thereof broken away to reveal the adjustor.
Figure 10:
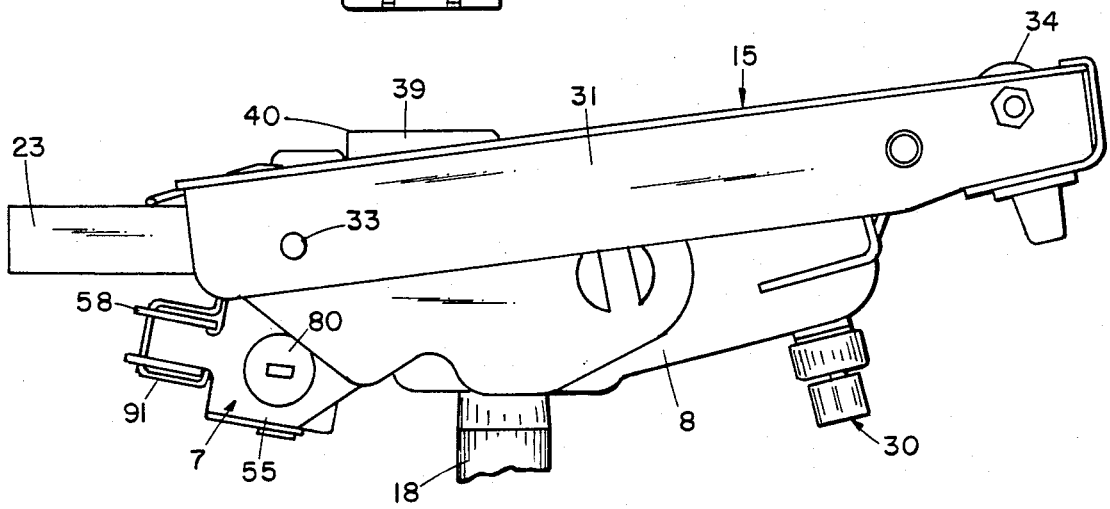
FIG. 10 is a side elevational view of the chair control.

In this example, spindle 5 (FIG. 8) is pivotally attached to rear stretchers 23 by a bracket 40. Bracket 40 has a generally inverted U-shaped elevational configuration, with a clevis bracket 41 at the raised center portion 39 thereof. An adapter sleeve 42 is attached to the upper end of spindle 5 by a pin 43, and adapter sleeve 42 is in turn pivotally retained in clevis bracket 41 by a pin 44 and retainer ring 45. As best illustrated in FIG. 5, bracket 40 includes four outwardly extending flanges 46, which are attached to rear stretchers 23 by suitable fasteners 47.

Spindle 5 has a high helix thread to provide smooth running, and to minimize the force required to adjust the angular position of chair back 4. In this example, spindle 5 has a four star thread, with a helical angle of one revolution for every two-thirds inch of length. However, it is to be understood that the precise pitch of the spindle threads may be varied to accommodate alternative applications.

Figure 7:
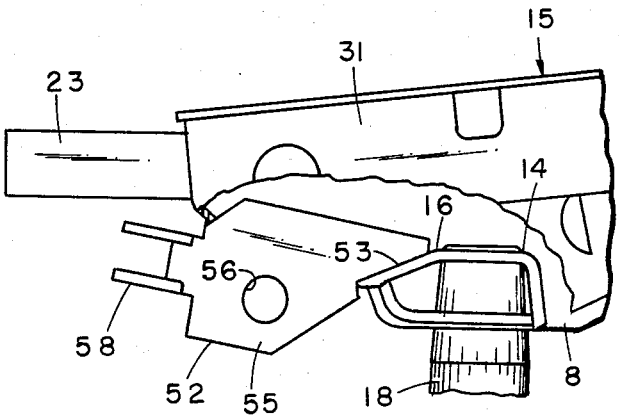
FIG. 7 is a fragmentary, side elevational view of the chair control, with a portion thereof broken away to show the adjustor bracket.

Gear wheel housing 7 is attached to the rear portion of stationary control housing 8 by a bracket 52 (FIG. 5). Bracket 52 has a generally inverted U-shaped elevational configuration, with an inclined forward edge 53 that is fixedly attached to column support bracket 16 by means such as welding or the like, as illustrated in FIG. 7. Both arms 54 and 55 (FIG. 5) of bracket 52 include an aperture 56, and a pair of clevis flanges 57 and 58 respectively for purposes to be described in greater detail hereinafter.

Figure 4:
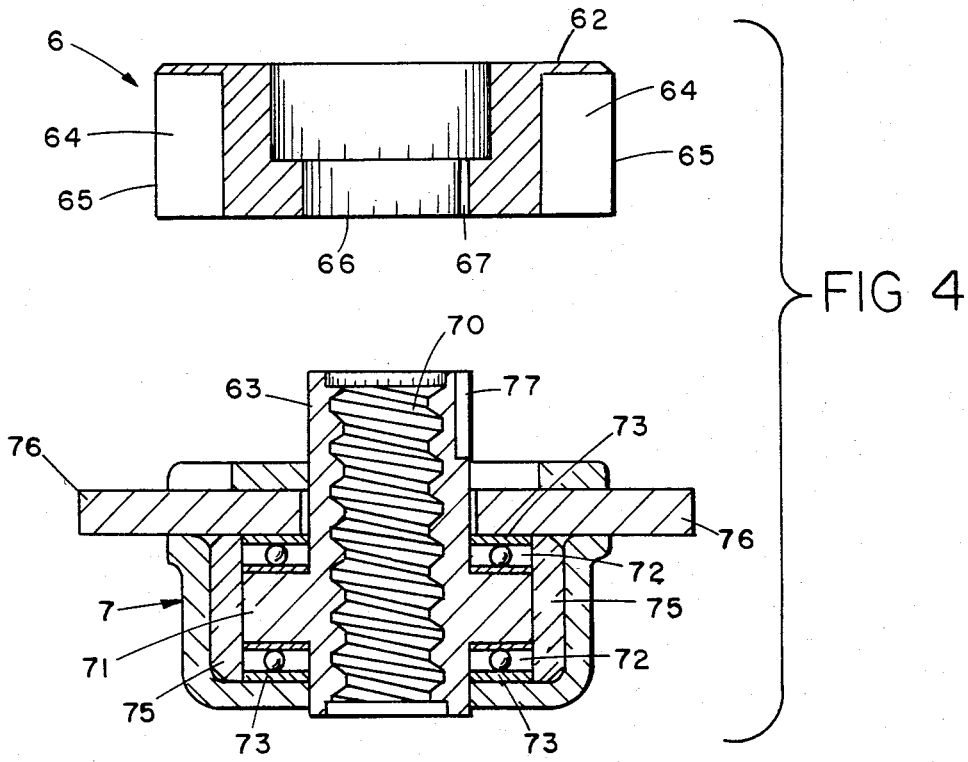
FIG. 4 is an enlarged, exploded view of a gear wheel and housing portion of the adjustor.

With reference to FIG. 4, gear wheel 6 has a two-part construction, comprising an upper disc 62, and a lower nut or sleeve 63. Disc 62 has a generally circular plan shape, and includes a plurality of radially extending slots 64, which form corresponding teeth 65 therebetween. The diameter of disc 62, and the number of teeth 65 desired is selected in accordance with the specific application. In this example, gear wheel 6 has a diameter of approximately 1½ inches, with a total of twenty teeth 65. Hence, the illustrated chair back has well over forty different positions which provide adjustment in very small increments. A central bore 66 is positioned coaxially in disc 62, and includes a radially extending key 67 at the lower end thereof. Although the illustrated gear wheels include teeth 65, it is to be understood that the term "gear wheel" as used herein, also contemplates other types of protrusions, recesses, or other irregularities which could be used in conjunction with a mating pawl 9.

The sleeve portion 63 of gear wheel 6 includes a threaded bore 70 in which spindle 5 is closely received. An annularly-shaped ring 71 is integrally formed at the lower end of sleeve 63, and protrudes outwardly thereof. A pair of thrust bearings 72 are positioned on either side of ring 71, and associated pairs of thrust washers 73 are mounted on opposite sides of thrust bearings 72 to rotatably mount sleeve 63 in gear wheel housing 7. An inner tube 75 axially positions thrust bearings 72 and thrust washers 73 inside housing 7. A bearing plate 76 extends axially through diametrically opposite sides of housing 7 to securely retain sleeve 63 axially within housing 7. The upper end of sleeve 63 includes a keyway 77 in which the key 67 of disc 62 is received to rotatably lock disc 62 on sleeve 63. In this manner, disc 62 can be removed and replaced if necessary. Gear wheel 6 is preferably constructed of a suitable synthetic resin material to reduce wear and engagement noise.

Bearing plate 76 extend radially outwardly of gear wheel housing 7, and the opposite ends are received through the mating apertures 56 in bracket 52, and are mounted in bearings 80 to pivotally retain gear wheel housing 7. Since both spindle 5 and gear housing 7 are pivotally mounted in their associated portions of the chair, when chair back 4 is tilted, spindle 5 will remain in alignment with gear wheel 6 to prevent any lateral strain or binding.

Pawl 9 (FIG. 5) has a plate-like shape, and includes an integrally molded sleeve 81, which is received between the flanges 57 of bracket arm 54, and is pivotally retained therein by a pin 82 to define a first pivot point 79. Retainer pin 82 is positioned substantially parallel with spindle 5. Hence, pawl 9 is mounted in bracket 52 to pivot along a generally horizontal plane. The free end of pawl 9 includes an outwardly extending tab or dog 83, which is shaped to be closely received within the peripheral slots 64 of gear wheel 6 to positively lock gear wheel 6 against rotation. In this example, the outer end of dog 83 is V-shaped to facilitate engagement with gear wheel 6. Pawl 9 also includes a longitudinally extending slot 84 at the free end thereof, and a ball joint 85 at the opposite end for purposes to be described in greater detail hereinafter. Pawl 9 is also preferably constructed of a suitable synthetic resin material to reduce wear and engagement noise.

Figure 11:
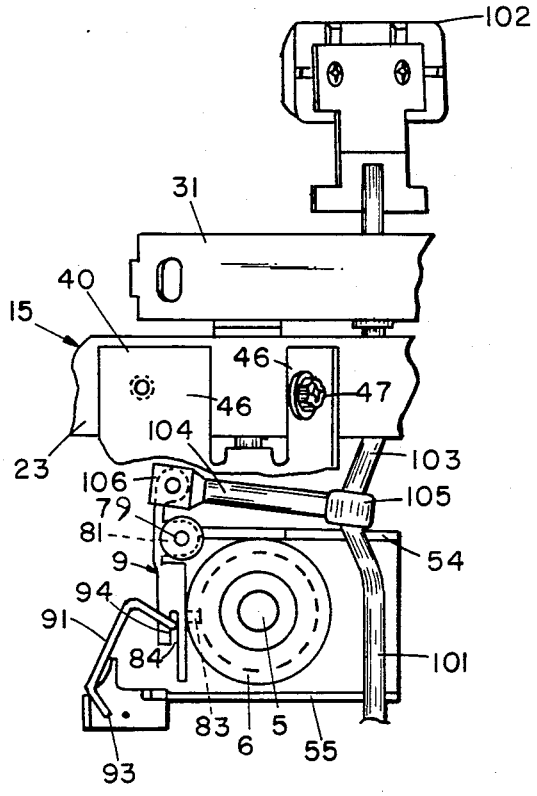
FIG. 11 is a top plan view of the adjustor, shown in a locked position.
Figure 12:
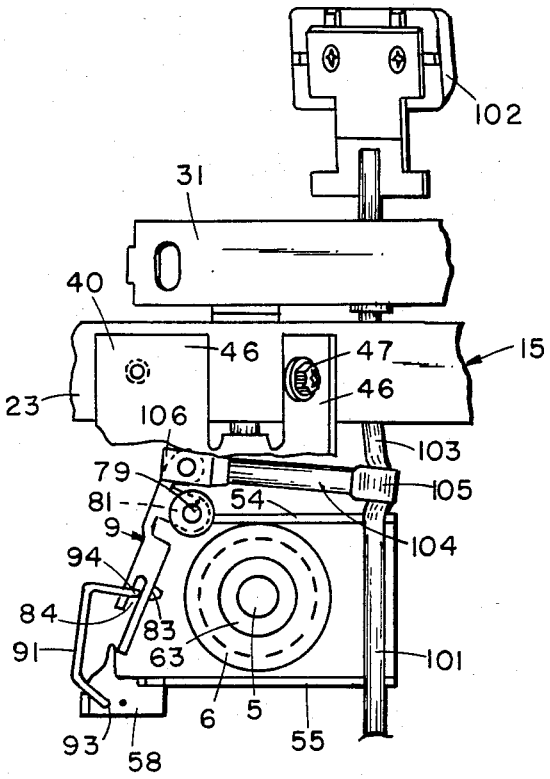
FIG. 12 is a top plan view of the adjustor, shown in an unlocked position.
Figure 13:
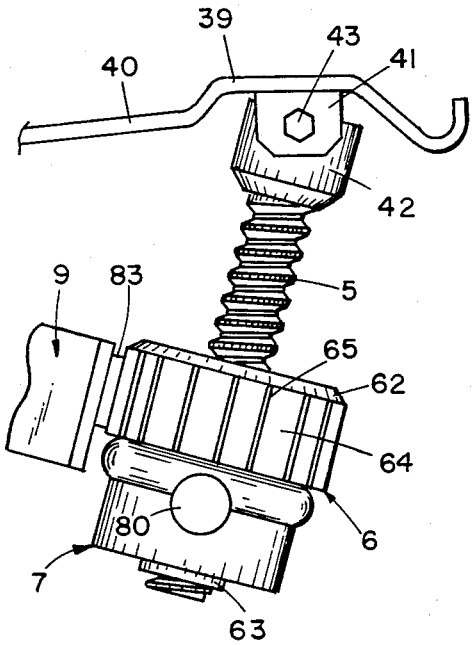
FIG. 13 is a partially schematic, side elevational view of the adjustor, shown in the locked position.
Figure 14:
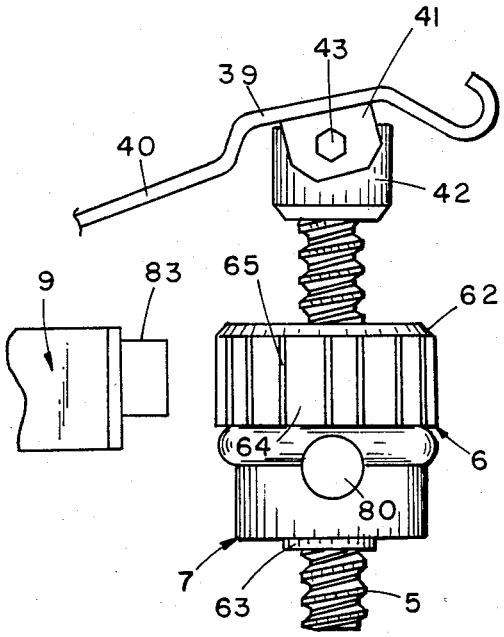
FIG. 14 is a partially schematic, side elevational view of the adjustor, shown in the unlocked position.

An over-centered spring arrangement 90 is provided to resiliently urge pawl 9 to either the fully locked position or the fully unlocked position. In this example, over-centered spring arrangement 90 comprises a looped wire spring 91 (FIG. 5) having a generally U-shaped plan configuration, with the free ends 92 thereof pivotally received through mating apertures in the flanges 58 of bracket arm 55 to define a second pivot point 93. The outer end 89 of spring 92 is received in the slot 84 at the free end of pawl 9, and pivots therein to define a third pivot point 94. Spring 91 is shaped so that the first, second and third pivot points, 79, 93 and 94 respectively are aligned when pawl 9 is in an intermediate position between the fully locked and fully unlocked positions. Hence, as best illustrated in FIGS. 11 and 12, as pawl 9 is pivoted rearwardly out of engagement with gear wheel 6, it passes through the neutral position in which the three pivot points 79, 93 and 94 are aligned, and is then urged resiliently outwardly into an over-centered, fully disengaged position (FIG. 12). In a like manner, when the pawl 9 is pivoted inwardly toward engagement with gear wheel 6, it passes through the neutral position of spring 91, and is then urged resiliently into engagement with gear wheel 6, as illustrated in FIG. 11.

As illustrated in FIG. 3, pawl 9 is manipulated by a toggle arrangement 100, comprising a laterally extending shaft 101 rotatably mounted in forward stretchers 31. A toggle button 102 is attached to the free end of shaft 101, and extends through a mating aperture on the lower surface of the seat chair shell (not shown) for easy access by the occupant. Shaft 102 includes a crank 103 at a medial portion thereof. A link 104 includes a hook-shaped forward end 105 to pivotally attach the same to crank 103. The rearward end 106 of link 104 includes a socket which is attached to the ball 85 on pawl 9 with a snap fit. Preferably, link 104 is longitudinally adjustable to insure proper engagement between pawl 9 and gear wheel 6.

In operation, to adjust the position of the chair back 4, the operator simply reaches beneath the seat portion 3 of chair 2, and locates toggle button 102. The user then depresses the upwardly protruding portion of the toggle button 102, thereby rotating shaft 101, and pivoting pawl 9 out of engagement with gear wheel 6. Over-centered spring 90 insures that pawl 9 is retained in the fully disengaged position, and thereby retains toggle button 102 in its corresponding unlocked position. The user then applies weight to the back and rear portion of chair 2, thereby causing it to tilt to the desired attitude. To lock the chair back in the selected position, the user simply pivots toggle button 102 into the locked position, which rotates shaft 101 in the opposite direction, and causes pawl 9 to engage an associated slot 64 in gear wheel 6. Again, over-centered spring arrangement 90 insures that pawl 9 is fully engaged with gear wheel 6, and that toggle button 102 assumes the associated locked position. The mechanical advantage achieved by the spindle and gear wheel arrangement provides a very secure locking action, which requires minimal force to release.

Adjustor 1 provides a purely mechanical mechanism, which is capable to positively locking the chain back in a wide variety of different angular positions. The high helix thread of spindle 5 minimizes the force necessary to adjust chair back 4, and in combination with gear wheel 6, greatly reduces the release force necessary to unlock the chair, even when very stiff return springs are used, as are required in multiple articulated chairs. The over-centered spring arrangement 90 insures that pawl 9 is either fully engaged or fully disengaged from gear wheel 6, and particularly adapts adjustor 1 for use in a toggle button type of control.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a chair having a tilting back which pivots relative to a mounting portion of said chair, the improvement of a variable back adjustment mechanism, comprising:

a first bracket to be mounted on said mounting portion;

a second bracket pivotally secured to said first bracket in overlying relationship thereto and to be operatively connected to said chair back;

a threaded spindle having one end thereof connected with one of said first and second brackets at a position on said one bracket spaced from said pivotal connection;

a gear wheel threadedly mounted on said spindle;

a gear wheel housing connected with the other of said first and second brackets spaced from said pivotal connection, and rotatably retaining said gear therein, whereby tilting said chair back pivots said two brackets and translates said spindle axially through said gear wheel, thereby rotating said gear wheel in said housing;

a pawl movably connected with said chair, and positioned to selectively engage said gear wheel to positively prevent rotation of said gear wheel with respect to said spindle;

means for shifting said pawl into and out of engagement with said gear wheel between locked and unlocked positions respectively, whereby said chair back can be locked in a plurality of different angular positions.

2. A chair as set forth in claim 1, wherein said pawl shifting means comprises:

a toggle button pivotally mounted on said chair for rotation between locked and unlocked positions; and a link having one end connected with said toggle button, and the other end connected with said pawl, whereby rotation of said toggle button between the locked and unlocked positions shifts said pawl into and out of engagement with said gear wheel.

3. A chair as set forth in claim 2, including:

an over-centered spring arrangement, which is connected with said pawl, and resiliently urges said pawl into engagement with said gear wheel when said toggle button is in the locked position.

4. A chair as set forth in claim 3, wherein said over-centered spring arrangement includes:

means for resiliently urging said pawl out of engagement with said gear wheel when said toggle button is in the unlocked position.

5. A chair as set forth in claim 4, wherein:

said gear wheel comprises a circular disc, having a peripheral surface with a plurality of regularly spaced slots; and said pawl includes an outwardly protruding dog shaped for close reception in one of said slots.

6. A chair as set forth in claim 5, wherein:

said pawl is pivotally mounted in said other of said chair back and said mounting portion of said chair.

7. A chair as set forth in claim 6, wherein:

said chair includes a stationary control housing defining said mounting portion of said chair.

8. A chair as set forth in claim 7, wherein:

said gear wheel housing is pivotally connected with said control housing; and said spindle has an upper end thereof pivotally connected with said back, whereby during angular rotation of said back, said spindle and said gear wheel are aligned.

9. A chair as set forth in claim 8, wherein:

said spindle has a high helix thread to minimize the force required to adjust the angular position of said back.

10. A chair as set forth in claim 9, wherein:

said chair includes a return spring connected with said back to resiliently urge said back into a fully upright position.

11. A chair as set forth in claim 1, including:

an over-centered spring arrangement, which is connected with said pawl, and resiliently urges said pawl into engagement with said gear wheel when said shifting means is in the locked position.

12. A chair as set forth in claim 1, including:

an over-centered spring arrangement, which is connected with said pawl, and resiliently urges said pawl out of engagement with said gear wheel when said shifting means is in the unlocked position.

13. A chair as set forth in claim 1, wherein:

said gear wheel comprises a circular disc, having a peripheral surface with a plurality of regularly spaced slots; and said pawl includes an outwardly protruding dog shaped for close reception in one of said slots.

14. A chair as set forth in claim 1, wherein:

said pawl is pivotally mounted in said other of said chair back and said mounting portion of said chair.

15. A chair as set forth in claim 1, wherein:

said chair includes a stationary control housing defining said mounting portion of said chair.

16. A chair as set forth in claim 15, wherein:

said gear wheel housing is pivotally connected with said control housing; and said spindle has an upper end thereof pivotally connected with said back, whereby during angular rotation of said back, said spindle and said gear wheel remain aligned.

17. A chair as set forth in claim 1, wherein:

said spindle has a high helix thread to minimize the force required to adjust the angular position of said back.

18. A chair as set forth in claim 1, wherein:

said chair includes a return spring connected with said back to resiliently urge said back into a fully upright position.

19. A chair as set forth in claim 18, wherein said shifting means comprises:

a toggle button pivotally mounted on said chair for rotation between locked and unlocked positions; and a link having one end connected with said toggle button, and the other end connected with said pawl, whereby rotation of said toggle button between the locked and unlocked positions shifts said pawl into and out of engagement with said gear wheel.

20. A variable back adjustment mechanism for a chair having a tilting back which pivots relative to a mounting portion of said chair, said adjustment mechanism comprising:

a first bracket to be mounted on said mounting portion;

a second bracket pivotally secured to said first bracket in overlying relationship thereto and to be operatively connected to said chair back;

a threaded spindle having one end thereof adapted for connection with one of said first and second brackets at a position on said one bracket spaced from said pivotal connection;

a gear wheel threadedly mounted on said spindle;

a gear wheel housing adapted for connection with the other of said first and second brackets at a position on said other bracket spaced for said pivotal connection, and rotatably retaining said gear therein, whereby tilting said chair back pivots said two brackets and translates said spindle axially through said gear wheel, thereby rotating said gear in said housing;

a pawl movably connected with the other of said chair back and said mounting portion, and positioned to selectively engage said gear wheel to positively prevent rotation of said gear wheel with respect to said spindle;

means for shifting said pawl into and out of engagement with said gear wheel between locked and unlocked positions respectively for locking said chair back in a plurality of different angular positions.

21. A chair back adjustment mechanism as set forth in claim 20, wherein said pawl shifting means comprises:

a toggle button adapted for pivotal mounting on said chair for rotation between locked and unlocked positions; and a link having one end connected with said toggle button, and the other end connected with said pawl, whereby rotation of said toggle button between the locked and unlocked positions shifts said pawl into and out of engagement with said gear wheel.

22. A chair back adjustment mechanism as set forth in claim 21, including:

an over-centered spring arrangement, which is connected with said pawl, and resiliently urges said pawl into engagement with said gear wheel when said toggle button is in the locked position.

23. A chair back adjustment mechanism as set forth in claim 22, wherein said over-centered spring arrangement includes:

means for resiliently urging said pawl out of engagement with said gear wheel when said toggle button is in the unlocked position.

24. A chair back adjustment mechanism as set forth in claim 23, wherein:

said gear wheel comprises a circular disc having a peripheral surface with a plurality of regularly spaced slots; and said pawl includes an outwardly protruding dog shaped for close reception in one of said slots.

25. A chair back adjustment mechanism as set forth in claim 24, including:

a first bracket adapted for connection with said back, and having means for pivotally mounting an upper end of said spindle therein; and a second bracket adapted for connection with a stationary control housing portion of said chair, and having means for pivotally mounting said housing therein, whereby during angular rotation of said back, said spindle and gear wheel remain in alignment.

26. A chair back adjustment mechanism as set forth in claim 25, wherein:

said spindle has a high helix thread to minimize the force required to adjust the angular position of said back.

27. A chair back adjustment mechanism as set forth in claim 26, wherein:

said pawl has one end thereof pivotally mounted in said second bracket at a first pivot point, with said dog positioned adjacent the other end of said pawl.

28. A chair back adjustment mechanism as set forth in claim 27, wherein:

said over-centered spring arrangement comprises a generally U-shaped wire spring, having one end pivotally mounted in said first bracket at a second pivot point, and the other end pivotally connected with the other end of said pawl at a third pivot point; said first, second and third pivot points being positioned for linear alignment when said pawl is in an intermediate position between said locked and unlocked positions.

29. A chair back adjustment mechanism as set forth in claim 28, wherein:

said toggle button is mounted on one end of a rod adapted for rotatable mounting in a seat support portion of said chair; said rod including a crank on which said one end of said link is rotatably mounted;

said pawl includes an arm portion extending from said first pivot point in a direction opposite said third pivot point; and said link other end is pivotally connected with the arm portion of said pawl.

30. A chair back adjustment mechanism as set forth in claim 29, wherein:

said gear wheel includes a threaded sleeve in which said spindle is closely received, with an outwardly extending annular ring adjacent a lower end thereof shaped for reception in said housing;

said housing includes a pair of thrust bearings, which are retained therein, and positioned on either side of said ring to facilitate rotation of said sleeve in said housing.

31. A chair back adjustment mechanism as set forth in claim 30, wherein:

said slotted peripheral surface of said gear wheel is detachably connected with an upper end of said sleeve.

* * * * *

UNITED STATES PATENT AND TRADEMARK OFFICE

CERTIFICATE OF CORRECTION

PATENT NO. : 4,494,795

DATED : January 22, 1985

INVENTOR(S) : Charles P. Roossien et al

It is certified that error appears in the above-identified patent and that said Letters Patent is hereby corrected as shown below:

Column 3, line 28:
"stretches" should be --stretchers--

Column 4, line 34:
"axially" should be --radially--

Column 4, line 44:
"extend" should be --extends--

Column 5, line 11:
"92" should be --91--

Column 5, line 65:
"chain" should be --chair--

Signed and Sealed this

*Twenty-second* Day of *October 1985*

[SEAL]

*Attest:*

*Attesting Officer*

DONALD J. QUIGG

*Commissioner of Patents and Trademarks—Designate*